US011730997B1

(12) United States Patent
Mai

(10) Patent No.: US 11,730,997 B1
(45) Date of Patent: Aug. 22, 2023

(54) INVERTED EXERCISE ASSEMBLY

(71) Applicant: Chien Mai, Cliffside Park, NJ (US)

(72) Inventor: Chien Mai, Cliffside Park, NJ (US)

( * ) Notice: Subject to any disclaimer, the term of this patent is extended or adjusted under 35 U.S.C. 154(b) by 0 days.

(21) Appl. No.: 17/686,034

(22) Filed: Mar. 3, 2022

(51) Int. Cl.
*A63B 21/00* (2006.01)
*A63B 23/02* (2006.01)

(52) U.S. Cl.
CPC ..... *A63B 21/0005* (2013.01); *A63B 21/4039* (2015.10); *A63B 23/0238* (2013.01); *A63B 2208/0276* (2013.01)

(58) Field of Classification Search
CPC ..... A63B 21/0005; A63B 21/4039; A63B 23/0238; A63B 2208/0276; A61H 1/0229; A61H 2201/0192; A61H 2201/1635; A61H 2203/0493; A61H 2201/1253; A61H 2205/081; A61H 1/0292; A61H 2201/1284; A61H 2201/1623; A61H 2201/1642; A61H 1/00
See application file for complete search history.

(56) References Cited

U.S. PATENT DOCUMENTS 3,173,415 A * 3/1965 Rubin ..... A63B 21/023 482/142
3,874,657 A * 4/1975 Niebojewski ..... A63B 21/16 482/142
3,918,710 A * 11/1975 Niebojewski ..... A63B 17/00 482/97
4,302,005 A * 11/1981 Silberman ..... A63B 21/4047 482/10
4,583,731 A * 4/1986 Crivello ..... A63B 23/025 482/130
5,637,079 A * 6/1997 Miller ..... A61H 1/0218 606/241
5,643,163 A * 7/1997 Chen ..... A63B 21/00054 482/142
5,899,469 A * 5/1999 Pinto ..... A61G 7/0528 280/47.35
6,213,923 B1 * 4/2001 Cameron ..... A63B 21/012 297/50
7,118,518 B1 * 10/2006 Teeter ..... A61H 1/0218 482/145
8,062,198 B2 * 11/2011 Wei ..... A61H 1/0218 482/145
8,342,978 B2 * 1/2013 Tamura ..... A63B 24/0021 473/226
8,556,787 B2 * 10/2013 Leier ..... A61H 1/0222 482/144

(Continued)

FOREIGN PATENT DOCUMENTS

WO WO8001878 9/1980

*Primary Examiner* — Garrett K Atkinson

(57) ABSTRACT

An inverted exercise assembly for provide spine exercise in an inverted position includes a base. The base has a plurality of wheels coupled to a bottom surface of the base. The plurality of wheels provides mobility to the inverted exercise assembly. A support is protruding out from the base and is in a vertical position when in use. A seat is coupled to the support and to the base. The seat provides a place where the head and the back of the user are positioned when in use. A foot rail coupled to the support provides a place for the feet of the user to rest against. A pair of hand rails is positioned adjacent to the seat and provides support when the user is using the inverted exercise assembly.

14 Claims, 3 Drawing Sheets

(56) References Cited

U.S. PATENT DOCUMENTS 8,764,617 B2 * 7/2014 Teeter ..... A61H 1/0292 482/126
9,220,359 B2 * 12/2015 Long ..... A63B 23/0216
9,789,346 B1 * 10/2017 Kime ..... A63B 23/1227
9,849,056 B2 * 12/2017 Chen ..... A63B 21/00069
D806,810 S 1/2018 Chen
10,035,039 B1 * 7/2018 Jui ..... A63B 23/1218
10,881,900 B2 1/2021 Brask
11,554,281 B2 * 1/2023 Johnston ..... A47C 11/00
2002/0095182 A1 * 7/2002 Taylor ..... A61G 13/009 606/241
2004/0157713 A1 * 8/2004 Kweon ..... A61H 1/0218 482/144
2005/0047901 A1 * 3/2005 Eggleston ..... B62B 3/12 414/800
2007/0161478 A1 * 7/2007 Yu ..... A61H 1/0218 482/145
2008/0254954 A1 * 10/2008 Kim ..... A63B 21/00047 482/113
2009/0054216 A1 * 2/2009 Teeter ..... A61N 5/06 482/144
2009/0054217 A1 * 2/2009 Teeter ..... A61H 1/0218 482/144
2010/0081551 A1 * 4/2010 Harley ..... A63B 21/0005 482/142
2012/0104818 A1 * 5/2012 Morris ..... A61G 7/1011 297/316
2013/0029812 A1 * 1/2013 Teeter ..... A61H 1/0292 482/126
2013/0079204 A1 * 3/2013 Wang ..... A61H 1/0222 482/144
2013/0079205 A1 * 3/2013 Leier ..... A61H 1/0222 482/144
2013/0150219 A1 * 6/2013 Chang ..... A61H 1/0229 482/144
2014/0287877 A1 * 9/2014 Saghafi ..... A61H 1/0229 482/13
2015/0051057 A1 * 2/2015 Carter ..... A63B 21/4037 482/142
2015/0305962 A1 * 10/2015 Noel ..... A61H 1/0229 602/36
2016/0228320 A1 * 8/2016 Mabry ..... A61F 5/042
2016/0324712 A1 * 11/2016 Carlin ..... A61H 1/0229
2016/0353937 A1 * 12/2016 Dunnom ..... A61G 5/1043
2017/0128309 A1 * 5/2017 Chen ..... A47C 7/52
2017/0239124 A1 * 8/2017 Cunningham ..... A63B 21/4043
2018/0271736 A1 * 9/2018 Leier ..... A61H 1/0292
2018/0333601 A1 * 11/2018 Coffman ..... A63B 21/0005
2019/0200770 A1 * 7/2019 Lan ..... A47C 7/628
2019/0231629 A1 8/2019 Chen
2020/0222754 A1 7/2020 Walker
2022/0143447 A1 * 5/2022 Johnston ..... A47C 11/00
2022/0183918 A1 * 6/2022 Behrendt ..... A47C 7/383

* cited by examiner

INVERTED EXERCISE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to spine exercise devices and more particularly pertains to a new spine exercise device for provide spine exercise in an inverted position.

(2) Description of Related Art Including Information Disclosed Under 37 CFR 1.97 and 1.98

The prior art relates to spine exercise devices. The prior art includes a variety of spine exercise devices comprising a padded material positioned proximate to the spine of the user. Furthermore, know prior art includes a variety of spine exercise devices being configured for inverted exercise. Known prior art lacks a portable spine exercise device being configured for the user performing inverted exercise whereby supporting the user in an inverted vertical position by the head of the user with support from a pair of hand rails.

BRIEF SUMMARY OF THE INVENTION

An embodiment of the disclosure meets the needs presented above by generally comprising a base. The base has a top surface and a bottom surface. The bottom surface has a plurality of corners. Each wheel of a plurality of wheels is coupled to a respective one of each of the corners. The plurality of wheels is configured for providing mobility to the inverted exercise assembly. A support is protruding out from the top surface of the base. The support is configured for being positioned vertical when in use. A seat has a back rest and a bottom rest. The seat is configured for positioning the top of the head of the user on a top surface of the bottom rest and positioning the back of the user on a peripheral surface of the back rest whereby the user is inverted relative to the inverted exercise assembly. A foot rail is coupled to the peripheral surface of the support. The foot rail has a foot rest. The foot rest is configured for positioning the foot of the user against. Each hand rail of a pair of hand rails has a ninety degree bend. Each of the hand rails has a top end and a bottom end. The top end of each of the hand rails is coupled to the support. The bottom end of each of the hand rails is coupled to the base. The pair of hand rails is configured for placement of the hand of the user whereby supporting the user when in-use.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
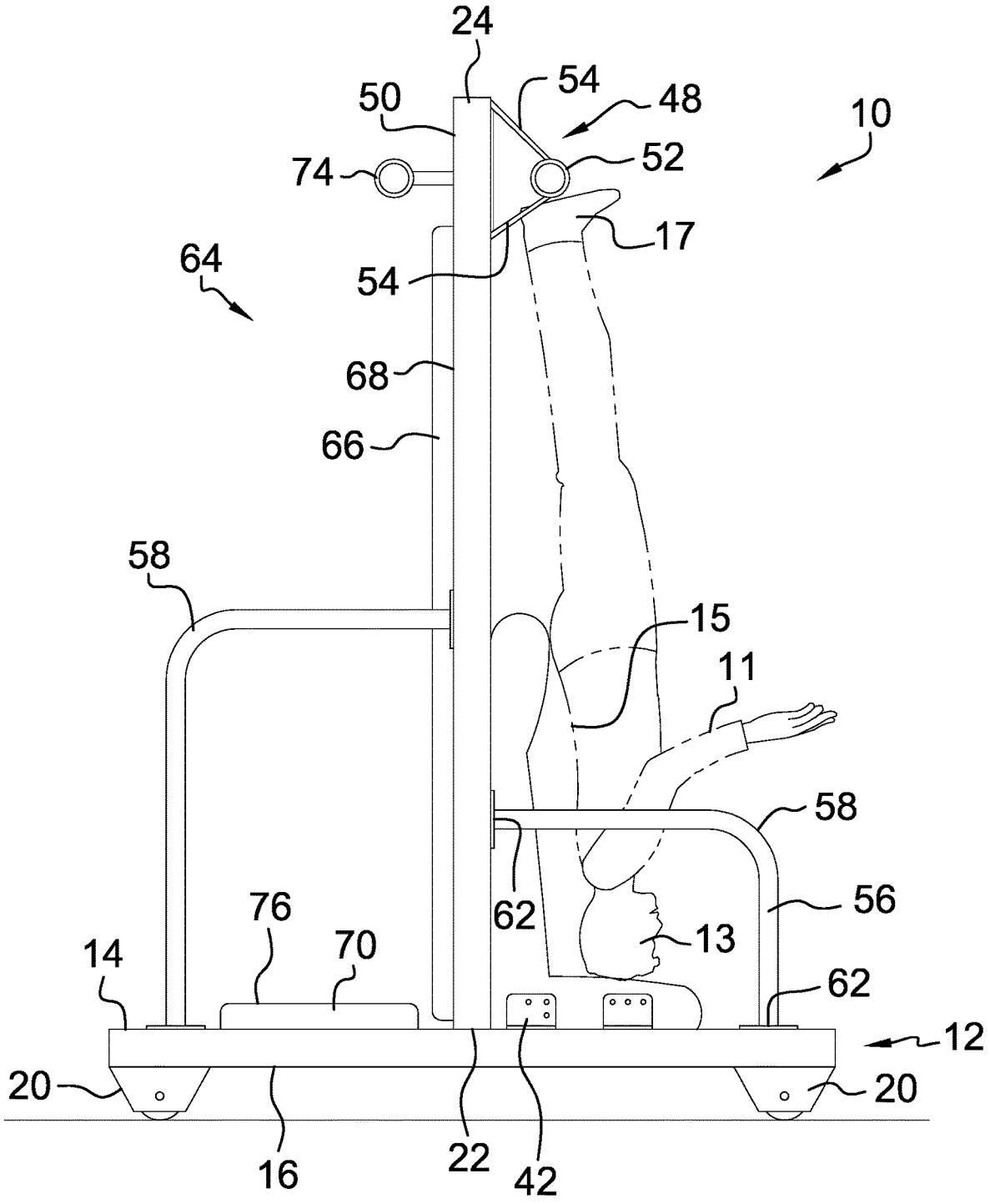
FIG. 1 is a front view of an inverted exercise assembly according to an embodiment of the disclosure.
Figure 2:
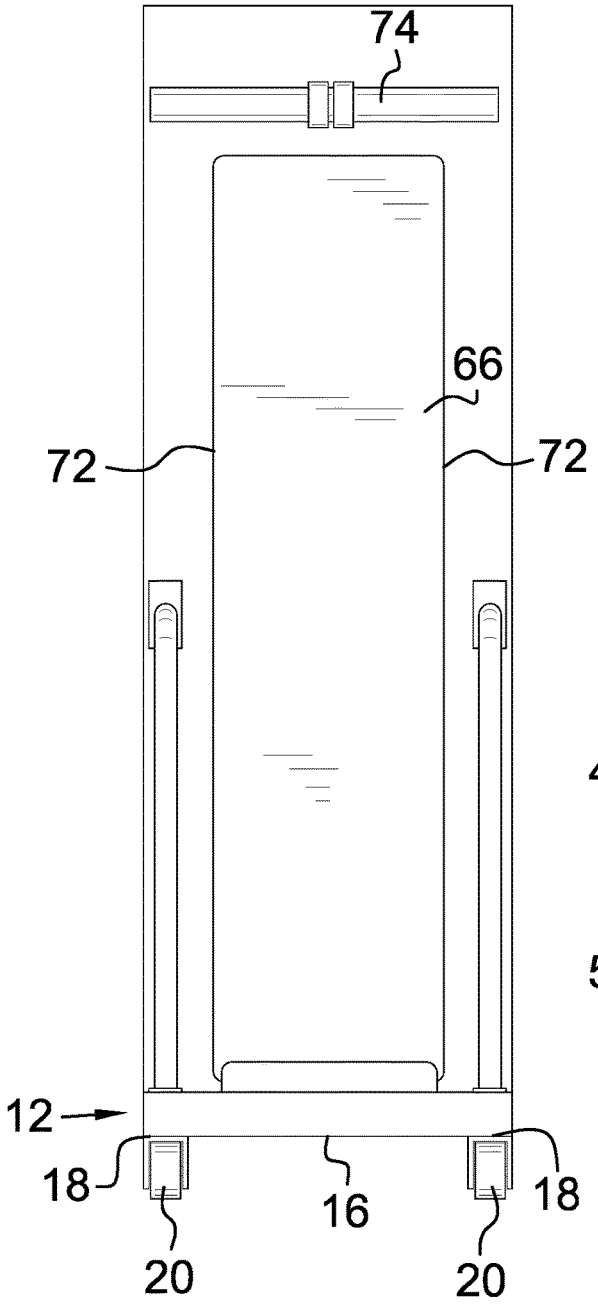
FIG. 2 is a left side view of an embodiment of the disclosure.
Figure 3:
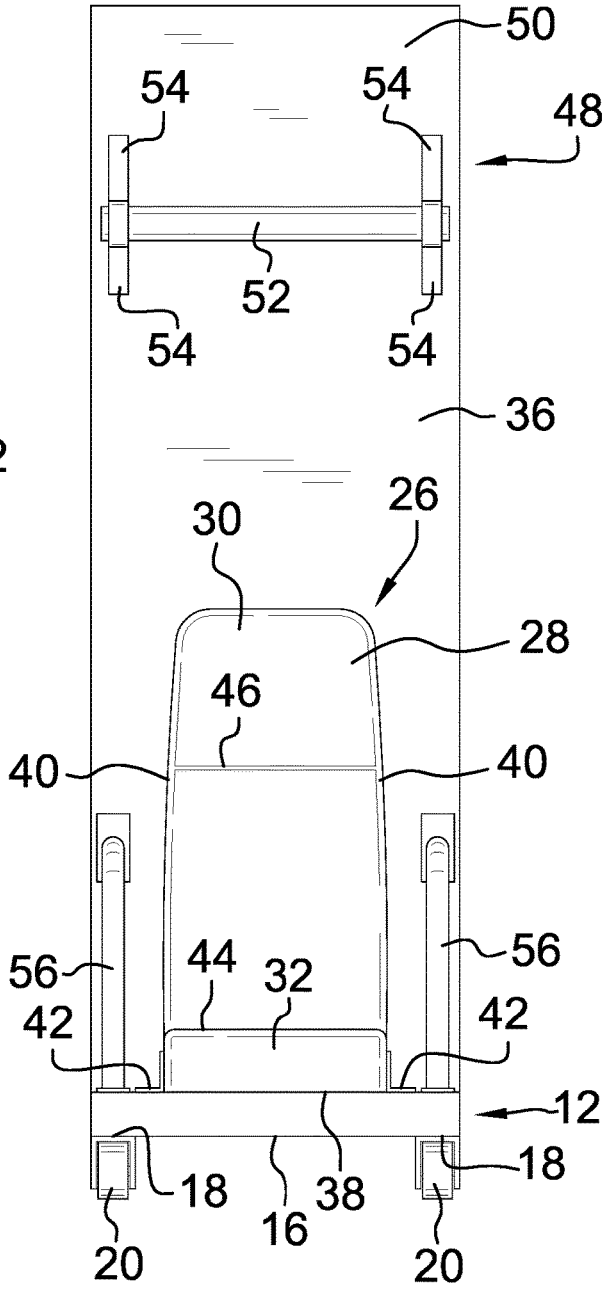
FIG. 3 is a right side view of an embodiment of the disclosure.
Figure 4:
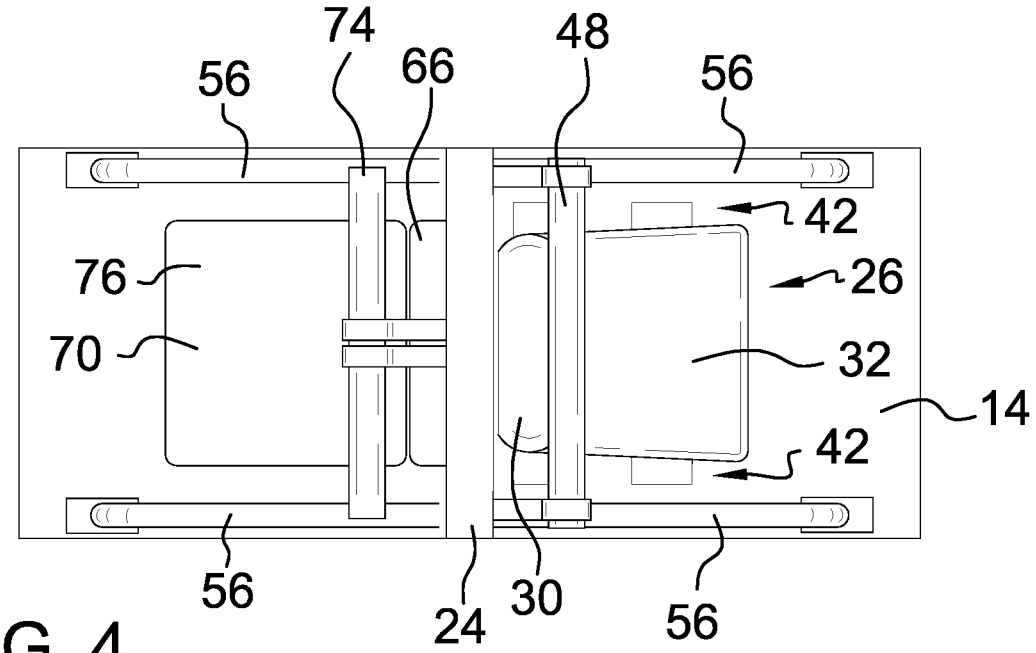
FIG. 4 is a top view of an embodiment of the disclosure.
Figure 5:
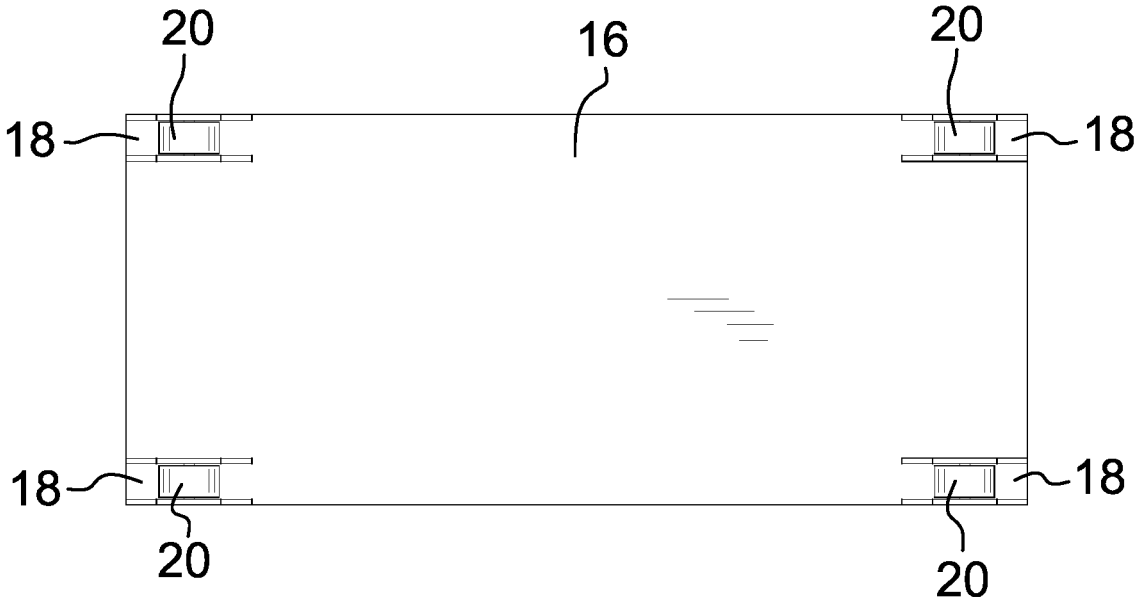
FIG. 5 is a bottom view of an embodiment of the disclosure.

With reference now to the drawings, and in particular to FIGS. 1 through 5 thereof, a new spine exercise device embodying the principles and concepts of an embodiment of the disclosure and generally designated by the reference numeral 10 will be described.

As best illustrated in FIGS. 1 through 5, the inverted exercise assembly 10 generally comprises a base 12. The base 12 is a rectangular shape. The base 12 has a top surface 14 and a bottom surface 16. The top surface 14 and the bottom surface 16 are parallel to each other.

The bottom 16 surface has a plurality of corners 18. Each wheel 20 of a plurality of wheels 20 is coupled to a respective one of each of the corners 18. Each of the wheels 20 is a caster wheel. The plurality of wheels 20 is configured for providing mobility to the inverted exercise assembly 10.

The base 12 has a center 22 in the top surface 14. A support 24 is positioned in the center 22 and is protruding out from the top surface 14. The support 24 is a rectangular prism and has a length to accommodate a range of heights for the user 11. The support 24 is positioned perpendicular relative to the base 12 and is configured for being positioned vertical when in use.

Shown in FIG. 1, the inverted exercise assembly 10 has a seat 26. The seat 26 is a foam material 28 whereby the foam material 28 is configured for providing comfort and reducing impact. The seat 26 has a back rest 30 and a bottom rest 32. The back rest 30 and bottom rest 32 are coupled to each other and are positioned perpendicular to each other.

A back surface 34 of the back rest 30 is coupled to a peripheral surface 36 of the support 24. A bottom surface 38 of the bottom rest 32 is coupled to the top surface 14 of the base 12. The seat 26 has a pair of sides 40. A pair of brackets 42 is coupled to each of the sides 40 of the seat. Each of the brackets 42 is configured for retaining the seat 26 in a fixed position to the base 12 with a plurality of bolts.

Shown in FIG. 1, the seat 26 is configured for positioning the top of the head 13 of the user 11 on a top surface 44 of the bottom rest 32. Furthermore, the back 15 of the user 11 is positioned on a peripheral surface 46 of the back rest 30 whereby the user 11 is inverted relative to the inverted exercise assembly 10.

A foot rail 48 is coupled to the peripheral surface 46 of the support 24. The foot rail 48 is positioned proximate to a distal 50 end of the support 24 relative to the base 12. The foot rail 48 has a foot rest 52. The foot rest 52 is configured for the foot 17 of the user 11 to be positioned against. The foot rest 52 is coupled to the support 24 by a plurality of beams 54. Each of the beams 54 is configured for restraining the foot rest 52 from movement.

Each hand rail 56 of a pair of hand rails 56 is a cylindrical tube. Each of the hand rails 56 has a ninety degree bend 58. Each of the hand rails 56 has a top end 60 and a bottom end 62. The top end 60 of each of the hand rails 56 is coupled to the peripheral surface 46 of the support 24, and the bottom end 62 of each of the hand rails 56 is coupled to the top surface 14 of the base 12.

Each of the hand rails 56 is positioned parallel to each other. Each of the hand rails 56 is positioned adjacent to a respective one of each of the sides 40 of the seat 26. The pair of hand rails 56 is configured for a placement the user 11 can grab onto and provide support when using the inverted exercise assembly 10.

An opposing side 64 of the inverted exercise assembly 10 has a pad 66 coupled to a back surface 68 of the support 24. The pad 66 is rectangular and elongated to accommodate the height of the user 11. The opposing side 64 has a bottom pad 70 coupled to the top surface 14 of the base 12. The bottom pad 70 and the pad 66 are the foam material 28.

The opposing side 64 has a pair of hand rails 56, and each of the hand rails 56 is adjacent to a respective one of each side 72 of a pair of sides 72 of the pad 66. The opposing side 64 has a foot rail 74. The foot rail 74 is coupled to the back surface 68 of the support 24. The foot rail 74 is positioned proximate to the distal end 50 of the support 24.

In use, the user 11 positions the top of their head 13 on the top surface 44 of the bottom rest 32. The user 11 can use the pair of hand rails 56 to hoist themselves up to position their back 15 on the peripheral surface 46 of the back rest 30. The user 11 can position their feet 17 on the foot rail 48 for increased stability when in use.

When in this position, the user 11 being inverted is configured for releasing head tension, increasing blood flow, and improving spine strength. The opposing side 64 of the inverted exercise assembly 10 can be used for the same function, whereby the user 11 positions the top of their head 13 on a top surface 76 of the bottom pad 70.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An inverted exercise assembly comprising:

a base, said base having a top surface and a bottom surface, said bottom surface having a plurality of corners, each wheel of a plurality of wheels being coupled to a respective one of each of said corners, said plurality of wheels being configured for providing mobility to said inverted exercise assembly;

a support, said support protruding out from said top surface, said support being configured for being positioned vertical when in use;

a seat, said seat having a back rest and a bottom rest, said seat being configured for positioning the top of the head of the user on a top surface of said bottom rest and positioning the back of the user on a peripheral surface of said back rest such that said user can be supported in an inverted position relative to said inverted exercise assembly, said seat being a foam material, said foam material configured for providing comfort and reducing impact;

a foot rail, said foot rail being coupled to a peripheral surface of said support, said foot rail having a foot rest, said toot rest being configured for positioning the foot of the user against; and a pair of hand rails, each of said hand rails having a ninety degree bend, each of said hand rails having a top end and a bottom end, said top end of each of said hand rails being coupled to said support, said bottom end of each of said hand rails being coupled to said base, said pair of hand rails being configured for placement of the hand of the user to support the user while in use; and an opposing side, said opposing side having a pad coupled to a back surface of said support, said pad being elongated to accommodate a height of a user, said opposing side having a bottom pad coupled to said top surface of said base, said bottom pad and said pad being said foam material, said opposing side having said pair of hand rails, each of said hand rails being adjacent to a respective one of each side of a pair of sides of said pad, said opposing side having said foot rail, said foot rail being couple to said back surface of said support, said foot rail being positioned proximate to said distal end of said support.

2. The inverted exercise assembly of claim 1, further comprising said base being a rectangular shape.

3. The inverted exercise assembly of claim 1, further comprising said top surface and said bottom surface being parallel to each other.

4. The inverted exercise assembly of claim 1, further comprising each of said wheels being a caster wheel.

5. The inverted exercise assembly of claim 1, further comprising said base having a center in said top surface.

6. The inverted exercise assembly of claim 5, further comprising said support being positioned in said center of said top surface of said base, said support being a rectangular prism.

7. The inverted exercise assembly of claim 1, further comprising said support having a length to accommodate a range of heights for the user.

8. The inverted exercise assembly of claim 1, further comprising said support being positioned perpendicular relative to said base.

9. The inverted exercise assembly of claim 1, further comprising said back rest and said bottom rest being coupled together, a back surface of said back rest being coupled to said peripheral surface of said support, a bottom surface of said bottom rest being coupled to said top surface of said base.

10. The inverted exercise assembly of claim 1, further comprising said seat having a pair of sides, a pair of brackets being coupled to each of said sides, each of said brackets being configured for retaining said seat to said base with a plurality of bolts.

11. The inverted exercise assembly of claim 1, further comprising said foot rail being positioned proximate to a distal end of said support relative to said base.

12. The inverted exercise assembly of claim 1, further comprising said foot rest being coupled to said peripheral surface of said support by a plurality of beams, each of said beams being configured for restraining said foot rest from movement.

13. The inverted exercise assembly of claim 10, further comprising each of said hand rails being a cylindrical tube, each of said hand rails being positioned parallel to each other, each of said hand rails being positioned adjacent to a respective one of each of said sides of said seat.

14. An inverted exercise assembly comprising:

a base, said base being a rectangular shape, said base having a top surface and a bottom surface, said top surface and said bottom surface being parallel to each other, said bottom surface having a plurality of corners, each wheel of a plurality of wheels being coupled to a respective one of each of said corners, each of said wheels being a caster wheel, said plurality of wheels being configured for providing mobility to said inverted exercise assembly, said base having a center in said top surface;

a support, said support being positioned in said center of said top surface of said base, said support protruding out from said top surface, said support being a rectangular prism, said support having a length to accommodate a range of heights for the user, said support being positioned perpendicular relative to said base, said support being configured for being positioned vertical when in use;

a seat, said seat being a foam material, said foam material configured for providing comfort and reducing impact, said seat having a back rest and a bottom rest, said back rest and said bottom rest being coupled together, a back surface of said back rest being coupled to a peripheral surface of said support, a bottom surface of said bottom rest being coupled to said top surface of said base, said seat having a pair of sides, a pair of brackets being coupled to each of said sides, each of said brackets being configured for retaining said seat to said base with a plurality of bolts, said seat being configured for positioning the top of the head of the user on a top surface of said bottom rest and positioning the back of the user on a peripheral surface of said back rest such that said user can be supported in an inverted position relative to said inverted exercise assembly;

a foot rail, said foot rail being coupled to said peripheral surface of said support, said foot rail being positioned proximate to a distal end of said support relative to said base, said foot rail having a foot rest, said foot rest being configured for positioning the foot of the user against, said foot rest being coupled to said peripheral surface of said support by a plurality of beams, each of said beams being configured for restraining said foot rest from movement;

a pair of hand rails, each of said hand rails being a cylindrical tube, each of said hand rails having a ninety degree bend, each of said hand rails having a top end and a bottom end, said top end of each of said hand rails being coupled to said support, said bottom end of each of said hand rails being coupled to said base, each of said hand rails being positioned parallel to each other, each of said hand rails being positioned adjacent to a respective one of each of said sides of said seat, said pair of hand rails being configured for placement of the hand of the user to support the user while in use; and an opposing side, said opposing side having a pad coupled to a back surface of said support, said pad being elongated to accommodate a height of a user, said opposing side having a bottom pad coupled to said top surface of said base, said bottom pad and said pad being said foam material, said opposing side having said pair of hand rails, each of said hand rails being adjacent to a respective one of each side of a pair of sides of said pad, said opposing side having said foot rail, said foot rail being couple to said back surface of said support, said foot rail being positioned proximate to said distal end of said support.

* * * * *